United States Patent [19]

Fukumoto et al.

[11] Patent Number: 4,665,651

[45] Date of Patent: May 19, 1987

[54] AUTOMOTIVE WINDOW REGULATOR MECHANISM USING WIRE AND METHOD OF MOUNTING SAME TO BODY

[75] Inventors: Ryoichi Fukumoto, Nagoya; Kimiharu Hirose, Obu, both of Japan

[73] Assignee: Aisin Seiki Kabushiki Kaisha, Japan

[21] Appl. No.: 746,293

[22] Filed: Jun. 19, 1985

[30] Foreign Application Priority Data

Jul. 6, 1984 [JP] Japan ..... 59-103034[U]

[51] Int. Cl.[4] ..... E05F 11/48

[52] U.S. Cl. ..... 49/352

[58] Field of Search ..... 49/352, 227

[56] References Cited

U.S. PATENT DOCUMENTS 4,480,409 11/1984 Hara ..... 49/352

FOREIGN PATENT DOCUMENTS 2915389 10/1981 Fed. Rep. of Germany ..... 49/352

2477479 9/1981 France ..... 49/352

1375737 11/1974 United Kingdom .

*Primary Examiner*—Kenneth Downey

*Attorney, Agent, or Firm*—Finnegan, Henderson, Farabow, Garrett & Dunner

[57] ABSTRACT

A window regulator mechanism using a wire for opening and closing an automobile window has a driving portion including a drum to which a handle shaft is mounted, two brackets, two pulleys pivotally mounted to the brackets, the wire being wound on the drum and trained around the pulleys to form a closed loop, two elastic tubes mounted between each bracket and the driving portion for guiding the wire and for always elastically connecting the brackets to the driving portion, and an auxiliary elastic member mounted between the driving portion and the portion of the wire which lies between the pulleys. The drum and the pulleys are disposed in a triangular form. The auxiliary member gives a tension to the wire to prevent the wire from disengaging from the pulleys when the mechanism is mounted to the panel.

8 Claims, 2 Drawing Figures

AUTOMOTIVE WINDOW REGULATOR MECHANISM USING WIRE AND METHOD OF MOUNTING SAME TO BODY

FIELD OF THE INVENTION

The present invention relates to a window regulator mechanism having a drum that winds up and moves a wire to elevate or lower the windowpane of a window for opening or closing the window and, more particularly, to an automotive window regulator mechanism using such a wire. The invention also relates to a method of readily mounting such a window regulator mechanism using a wire to a window frame.

BACKGROUND OF THE INVENTION

A window regulator mechanism using a wire of this kind is disclosed in British Patent No. 1,375,737, where a pair of pulleys rotatably mounted on brackets forms a triangular arrangement together with the drum of a driving portion. A wire wound on the drum is trained around the pulleys and forms a closed loop. In order to open or close the window, the drum is rotated to move the wire, thus elevating or lowering the windowpane joined to the wire. The pulleys are connected to the driving portion via the brackets to which the pulleys are pivotally mounted. This prevents the wire from disengaging from the pulleys. Therefore, the window regulator mechanism using the wire is mounted in a door having a window while maintaining the triangular arrangement. Thus, an excessively large access hole is formed in an inner door panel to permit the mounting operation. The window regulator mechanism is introduced into the door through this hole, and then the regulator mechanism is rigidly attached to the door. Consequently, the large hole makes it impossible to place components to be mounted to the inner door panel, such as an inside door handle and an armrest, in their optimum positions. Further, the large size of the access hole reduces the mechanical strength. Thus, if the door is closed violently, the inner door panel is depressed.

SUMMARY OF THE INVENTION

In view of the foregoing difficulties with the prior art mechanism, it is an object of the present invention to provide a window regulator mechanism which uses a wire capable of deforming without disengaging from pulleys and which, therefore, can be introduced into a door through a relatively small access hole.

It is another object of the invention to provide a method of mounting the window regulator mechanism described just above to the body of an automobile.

These objects are achieved by a window regulator mechanism comprising: two pulleys which are pivotally mounted to first and second brackets, respectively; a driving portion; elastic tubes disposed between each bracket and the driving portion and acting to guide a wire and to elastically connect the brackets to the driving portion; and an elastic member mounted between the driving portion and the portion of the wire which extends between the pulleys for imparting a tension to the wire to prevent the wire from disengaging from the pulleys when the mechanism is mounted.

In the window regulator mechanism constructed as described above, the brackets are elastically connected to the driving portion by the elastic tubes. Therefore, the elastic member disposed between said portion of the wire and the driving portion permits the elastic tubes to be elastically deformed in such a way that the wire does not disengage from the pulleys. Hence, the distance between the pulleys can be reduced, making the whole window regulator mechanism thin. Consequently, the regulator mechanism can be put into a door through a small access hole. After it is put in the door, the elastic tubes are released, so that they assume their original shape. As a result, the window regulator mechanism forms a triangular arrangement. Hence, the driving portion and the brackets can be readily fixed at given positions on an inner door panel.

DETAILED DESCRIPTION OF THE INVENTION

Figure 1:
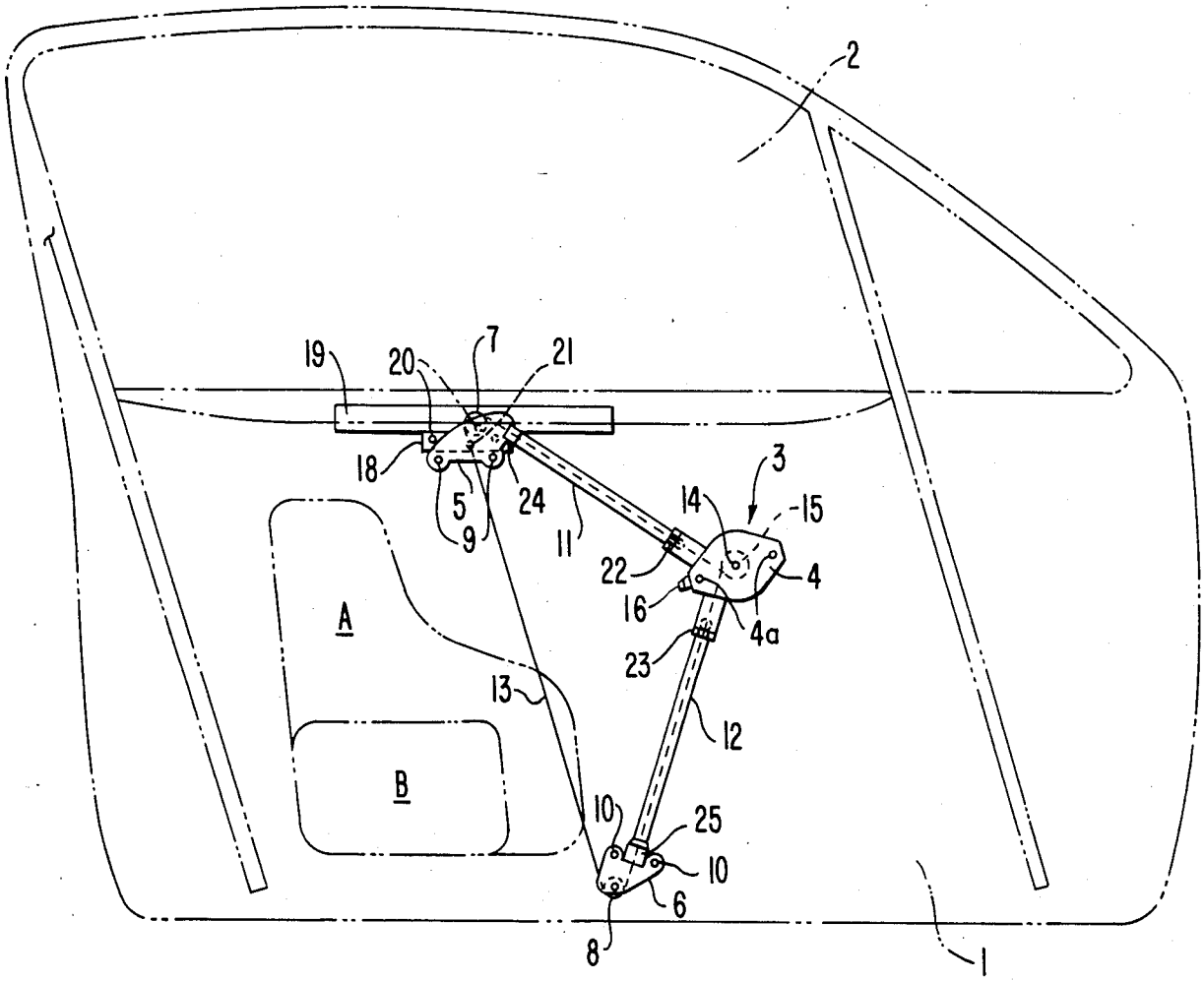
FIG. 1 is a front elevation of a window regulator mechanism according to the invention, for showing the condition in which the mechanism is mounted in a door.

Referring to FIG. 1, a door 1 of an automobile has a glass (windowpane) 2, which is so mounted as to be slidable vertically. Note that the inner door panel is not shown. The door glass 2 is elevated or lowered by a window regulator mechanism which uses a wire and is constructed as described below.

The regulator mechanism has a driving portion 3 that comprises a handle shaft 14, a drum 15, and a base member 4. The shaft 14 is rotatably held to the base member 4. A handle (not shown) is attached to one end of the shaft. Also, the drum 15 is pivotally mounted to the shaft 14. The shaft 14 is operatively connected to the drum 15 via a known spring frictional brake mechanism (not shown). Thus, the drum 15 is rotated by rotating the handle.

Pulleys 7 and 8 are disposed on the left side of the drum 15 at upper and lower positions, respectively, as viewed in FIG. 1. The drum 15 and the pulleys 7 and 8 form a triangle. The pulleys 7 and 8 are pivotally mounted to brackets 5 and 6, respectively. A wire 13 is trained around the drum 15 and the pulleys 7, 8 and forms a closed loop. Each end of the wire 13 is wound several turns on the drum 15 and fixed to the drum 15.

An elastic tube 11 for guiding the wire 13 is disposed between the base member 4 of the driving portion 3 and the bracket 5 to which the pulley 7 is pivotally mounted. Similarly, another elastic tube 12 for guiding the wire 13 is disposed between the base member 4 and the bracket 6 to which the pulley 8 is pivotally mounted. The tube 11 is fixed to the base member 4 and to the bracket 5 via retainers 22 and 24 mounted at both ends of the tube 11. Likewise, the tube 12 is fixed to the base member 4 and to the bracket 6 via retainers 23 and 25 mounted at both ends of the tube 12. That is, the brackets 5 and 6 are elastically connected to the base member 4 via the elastic tubes 11 and 12, respectively.

The portion of the wire 13 which lies between the pulleys 7 and 8 is exposed. A hook 21 is fixed to this wire portion, and is retained to a holder 18. This holder 18 is rigidly held to a bracket 19, which holds the door glass 2. Thus, the glass 2 is elevated or lowered by moving the wire 13. More specifically, when the hook 21 is placed on the side of the pulley 7, the window is closed as shown in FIG. 1. When the hook is placed on the side of the pulley 8, the window is opened. The holder 18 is provided with access holes 20 to permit the holder 18 to be rigidly secured to the bracket 19 through the holes 20. Also, the brackets 5 and 6 and the base member 4 are provided with access holes 9, 10, 4*a*, respectively, to allow these components to be firmly fixed to the inner door panel (not shown) by means of bolts or the like.

Figure 2:
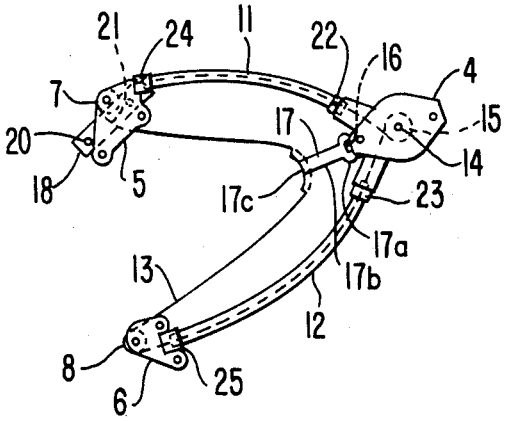
FIG. 2 is a front elevation of the mechanism shown in FIG. 1, for showing the shape of the mechanism that is taken when it is introduced into a door.

A retaining portion 16 is integrally formed with one end of the base member 4. As shown in FIG. 2, one end of an elastic member 17 can come into engagement with the retaining portion 16. The elastic member 17 is composed of an anchoring portion 17*a*, an elastic portion 17*b* as made of a rubber band, and a wire-retaining portion 17*c*. The anchoring portion 17*a* is retained to the retaining portion 16 and the wire-retaining portion 17*c* is held to substantially the middle of the portion of the wire 13 between the pulleys 7 and 8. The tensile force of the elastic member 17 pulls the wire 13 toward the driving portion 3. The wire 13 is pulled as the closed loop. Since the brackets 5 and 6 are elastically connected to the driving portion 3 via the elastic tubes 11 and 12, the movement of the wire 13 toward the driving portion 3 curves the elastic tubes 11 and 12 and moves the pulleys 7 and 8 toward each other. In this way, the whole window regulator mechanism takes a slender form as shown in FIG. 2.

In this case, the wire 13 is pulled toward the driving portion 3 while a tension is given to it by the elastic member 17. Consequently, the wire 13 is prevented from disengaging from the pulleys 7 and 8. More preferably, the pulleys 7 and 8 have retaining portions to assure that the wire 13 is prevented from disengaging from the pulleys 7 and 8. The biasing force exerted by the elastic member can also be applied in such a direction that the wire 13 is moved away from the driving portion 3. Further, it is unlikely that the elastic tubes 11 and 12 are locally bent, because the wire 13 is inserted in the tubes 11 and 12.

That is, by elastically deforming the elastic tubes 11 and 12, the whole window regulator mechanism is made thin. Therefore, the regulator mechanism can be inserted through an access hole B formed in the inner door panel, the hole B being much smaller than the conventional access hole A. After the insertion, the elastic member 17 is disconnected from the wire 13 and the retaining portion 16. Then, the elastic tubes 11 and 12 take their original shapes, moving the pulleys 7 and 8 to their original positions. As a result, the drum 15 and the pulleys 7 and 8 again form the triangle. Thus, the base member 4 of the driving portion 3 and the brackets 5 and 6 for the pulleys 7 and 8 can be rigidly attached to the inner door panel with ease.

The base member 4 of the driving portion 3 and the brackets 5 and 6 for the pulleys 7 and 8 should be attached to the inner door panel in the manner described below. After the insertion of the mechanism into the door, the base member 4 of the driving portion 3 is firmly secured to the panel. Thereafter, the elastic member 17 is removed, followed by attachment of the brackets 7 and 8 to the panel. It is also possible to attach the base member 4 and the brackets 5 and 6 to the panel while stretching the elastic member 17, prior to the removal of the elastic member 17.

After the window regulator mechanism is firmly fixed to the inner door panel, the holder 18 is held to the bracket 19 that retains the door glass 2, thus completing the assembly operation. Then, the glass 2 can be elevated or lowered by the regulator mechanism.

In an attempt to eliminate the difficulties with the prior art technique, an arrangement might be contemplated in which the brackets are screwed to the driving portion such that the brackets to which the pulleys are pivotally mounted are foldable. However, the coupling using screws makes the structure complex.

In contrast, the present invention provides a simple structure making use of elastic tubes. In addition, the brackets to which the pulleys are pivotally mounted can be rendered small. This makes the window regulator mechanism lightweight.

What is claimed is:

1. A wire-type window regulator of the type that is insertable through an access hole in a motor vehicle door panel and mountable on the door panel for raising and lowering a motor vehicle door window, the window regulator comprising:

a. a base member mountable on the door panel;

b. a pair of tubes each having a first end rigidly connected to said base member and a second end extending away from said base member, said tubes being elastically bendable between a mounting condition in which said second ends are normally separated by a predetermined distance and an inserting condition in which said second ends are bent toward each other and are separated by a distance substantially less than said predetermined distance to make the regulator thinner and facilitate inserting the regulator through the access hole of the door panel;

c. a pair of brackets each connected to said second end of one of said tubes, said brackets being mountable on the door panel in a vertically spaced relationship;

d. a pair of pulleys each pivotally mounted on one of said brackets;

e. a drum pivotally mounted on said base member;

f. a closed loop of wire wound around said pulleys and said drum, said wire loop including first and second wire segments each running between said drum and one of said pulleys through the interior of one of said tubes and a third wire segment running between said pair of pulleys and being connectable to the door window, so that when said regulator is mounted on the motor vehicle panel and said third wire segment is connected to the door window rotation of said drum moves said wire along its length to raise or lower the window; and g. elastic means removably connected between said base member and said third wire segment for retaining tension in said wire loop and preventing said wire loop from disengaging from said pulleys when said tubes are in said inserting condition.

2. The wire-type window regulator as set forth in claim 1, wherein said elastic means includes a rubber band.

3. The wire-type window regulator as set forth in claim 1, wherein said base member includes a retaining portion engageable with said anchoring portion of said auxiliary elastic member.

4. A method of mounting a window regulator mechanism to an inner door panel of an automobile, the mechanism comprising: a driving portion equipped with a drum to which a handle shaft is mounted so as to be rotatable with the drum, the driving portion also having a base member; two brackets; two pulleys pivotally mounted to the respective brackets, the drum and the pulleys being disposed in a triangular form; a wire that is wound on the drum and trained around the pulleys to form a closed loop; two elastic tubes mounted between each bracket and the driving portion for guiding the wire and for always elastically connecting the brackets to the driving portion; and an auxiliary elastic member mounted between the driving portion and the portion of the wire which lies between the pulleys for giving a tension to the wire; the method comprising the steps of:

rigidly attaching the base member of the driving portion to the inner door panel;

then removing the auxiliary elastic member; and thereafter rigidly attaching the brackets to the inner door panel.

5. A method of mounting a window regulator mechanism to an inner door panel of an automobile, the mechanism comprising: a driving portion equipped with a drum to which a handle shaft is mounted so as to be rotatable with the drum, the driving portion also having a base member; two brackets; two pulleys pivotally mounted to the respective brackets, the drum and the pulleys being disposed in a triangular form; a wire that is wound on the drum and trained around the pulleys to form a closed loop; two elastic tubes mounted between each bracket and the driving portion for guiding the wire and for always elastically connecting the brackets to the driving portion; and an auxiliary elastic member mounted between the driving portion and the portion of the wire which lies between the pulleys for giving a tension to the wire; the method comprising the steps of:

rigidly attaching the base member of the driving portion and the brackets to the inner door panel while stretching the auxiliary elastic member; and then removing the auxiliary elastic member.

6. The wire-type window regulator of claim 1, wherein said elastic means includes an auxiliary elastic member having an anchoring portion connectable to said base member and a wire-retaining portion connectable to said third segment of said wire loop.

7. A method of mounting a window regulator mechanism to an automobile inner door panel having an access hole, the mechanism comprising: a driving portion equipped with a drum to which a handle shaft is mounted so as to be rotatable with the drum, the driving portion also having a base member; two brackets; two pulleys pivotally mounted to the respective brackets, the drum and the pulleys being disposed in a triangular form; a wire that is wound on the drum and trained around the pulleys to form a closed loop; and two elastic tubes each rigidly connected between one bracket and the driving portion for guiding the wire and for elastically connecting the brackets to the driving portion; the method comprising the steps of:

a. attaching an auxiliary elastic member between the driving portion and a portion of the wire extending between the two pulleys to apply a tension to the wire and bend the tubes toward each other so that the brackets are positioned closer to each other and the width of the mechanism is decreased;

b. inserting the mechanism through the access hole in the inner door panel while the auxiliary elastic member is connected between the wire and the driving portion;

c. rigidly attaching the base member of the driving portion to the inner door panel;

d. then removing the auxiliary elastic member to permit the tubes to unbend; and e. thereafter ridgidly attaching the brackets to the inner door panel.

8. A method of mounting a window regulator mechanism to an automobile inner door panel having an access hole, the mechanism comprising: a driving portion equipped with a drum to which a handle shaft is mounted so as to be rotatable with the drum, the driving portion also having a base member; two brackets; two pulleys pivotally mounted to the respective brackets, the drum and the pulleys being disposed in a triangular form; a wire that is wound on the drum and trained around the pulleys to form a closed loop; and two elastic tubes each rigidly connected between one bracket and the driving portion for guiding the wire and for elastically connecting the brackets to the driving portion; the method comprising the steps of:

a. attaching an auxiliary elastic member between the driving portion and a portion of the wire extending between the two pulleys to apply a tension to the wire and bend the tubes toward each other so that the brackets are positioned closer to each other and the width of the mechanism is decreased;

b. inserting the mechanism through the access hole in the inner door panel while the auxiliary elastic member is connected between the wire and the driving portion;

c. rigidly attaching the base member of the driving portion to the inner door panel;

d. then unbending the tubes while stretching the auxiliary elastic member and rigidly attaching the brackets to the inner door panel; and e. thereafter removing the auxiliary elastic member.

* * * * *